US006540132B1

(12) United States Patent
Lowry et al.

(10) Patent No.: US 6,540,132 B1
(45) Date of Patent: Apr. 1, 2003

(54) NON-ROUND COMPOSITE CONTAINER WITH INVERSE CURVATURE

(75) Inventors: James W. Lowry, Florence, SC (US); Steve Gendreau, Franklin, TN (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/913,894

(22) PCT Filed: Apr. 28, 2000

(86) PCT No.: PCT/US00/11815

§ 371 (c)(1),
(2), (4) Date: Oct. 9, 2001

(87) PCT Pub. No.: WO00/66438

PCT Pub. Date: Nov. 9, 2000

Related U.S. Application Data

(63) Continuation of application No. 29/104,209, filed on Apr. 30, 1999, now Pat. No. Des. 428,810.

(51) Int. Cl.[7] ..... B65D 3/02
(52) U.S. Cl. ..... 229/117.12; 220/771; 229/4.5
(58) Field of Search ..... 229/4.5, 117.12; 220/669, 670, 671, 672, 771

(56) References Cited

U.S. PATENT DOCUMENTS

| | | | | |
|---|---|---|---|---|
| D28,641 | S | 5/1898 | Richards | D9/414 |
| 868,447 | A | 8/1907 | Rice | 220/557 |
| D59,108 | S | 9/1921 | Hothersall | D9/542 |
| 1,949,421 | A | 3/1934 | Juelson | 220/527 |
| 2,111,884 | A | 3/1938 | Cahaney | 229/115 |
| 2,120,898 | A | 6/1938 | Moore | 229/125.09 |
| 2,120,900 | A | 6/1938 | Moore | 229/125.09 |
| 2,292,499 | A | 8/1942 | Walsh | 220/527 |
| 2,387,392 | A | 10/1945 | Guyer et al. | 229/125.09 |
| D146,127 | S | 12/1946 | Billups | D9/523 |
| 2,689,076 | A | 9/1954 | Jenkins | 229/115 |
| 3,093,288 | A | 6/1963 | Stark | 229/415 |
| D198,407 | S | 6/1964 | Busch | D9/543 |
| 3,232,495 | A | 2/1966 | Schneider | D9/523 |
| 3,390,828 | A | 7/1968 | Malby et al. | 229/117.12 |
| 3,402,871 | A | 9/1968 | Palmer | 229/4.5 |
| D217,333 | S | 4/1970 | Weckman | D9/543 |
| D226,704 | S | 4/1973 | Cobb | D9/542 |
| 3,780,899 | A | 12/1973 | Roper | 220/669 |
| 4,327,861 | A | 5/1982 | Thompson | 229/117.12 |
| D272,419 | S | 1/1984 | Persch | D9/420 |
| D273,167 | S | 3/1984 | Carlson | D7/612 |
| D284,728 | S | 7/1986 | Trivison | D7/629 |
| D308,336 | S | 6/1990 | Delbanco | D9/572 |
| 5,000,375 | A | 3/1991 | Färber | 229/116.1 |
| 5,103,988 | A | 4/1992 | Reil et al. | 220/771 |
| 5,122,399 | A | 6/1992 | Farrell et al. | 229/5.84 |
| D328,011 | S | 7/1992 | Rickabaugh | D7/612 |
| D350,876 | S | 9/1994 | Van Valkenburg et al. | D7/612 |
| D351,969 | S | 11/1994 | Daenen et al. | D7/603 |
| D361,474 | S | 8/1995 | Latella, Jr. | D7/612 |
| D364,344 | S | 11/1995 | Shaw | D9/421 |
| D375,873 | S | 11/1996 | Ahern, Jr. et al. | D7/612 |
| D382,446 | S | 8/1997 | Bacon | D7/587 |
| 5,669,549 | A | 9/1997 | Robertson | 229/4.5 |
| 5,669,550 | A | 9/1997 | Klemme et al. | 229/4.5 |
| 5,752,646 | A | 5/1998 | Sandstrom | 229/4.5 |
| D395,204 | S | 6/1998 | Wood | D7/615 |
| D413,231 | S | 8/1999 | Loew et al. | D7/612 |
| D428,810 | S | 8/2000 | Lowry et al. | D7/612 |

*Primary Examiner*—Gary E. Elkins
(74) *Attorney, Agent, or Firm*—Alston & Bird LLP

(57) ABSTRACT

The disclosure relates to tubular, non-round composite paperboard container bodies having at least one wall portion defined by radially inverse curvature, and at least a second wall portion that is outwardly curved. In one preferred embodiment, the container body includes at least two body wall portions of inverse curvature, which are positioned in an opposed relationship. The two opposed body wall portions having inverse curvature provide an integral handle allowing easy grasping of the container body by the hand of a consumer, i.e. by the opposed thumb and fingers of a consumer.

24 Claims, 5 Drawing Sheets

NON-ROUND COMPOSITE CONTAINER WITH INVERSE CURVATURE

The application is a continuation of Ser. No. 29/104,209 filed Apr. 30, 1999 now U.S. Pat. No. Des. 428,810.

FIELD OF THE INVENTION

The present invention relates to tubular, composite paperboard container bodies and to composite containers formed therefrom. More particularly, the present invention relates to tubular, composite paperboard container bodies with inverse curvature and to containers made from such bodies.

BACKGROUND OF THE INVENTION

Composite, tubular container bodies formed of paperboard in combination with other materials are widely used to package consumer food products and other products. Such container bodies generally have a curved, continuous wall formed by wrapping a plurality of plies onto a forming mandrel. For example, round composite containers are used to package food products such as orange juice, snack products, dough products, and the like, and also for packaging of other consumer and industrial products.

Alternative paperboard containers formed by folding and gluing flat paperboard blanks into various box-shaped configurations are also widely used to package various products including consumer food products. In order to maintain product freshness, particularly in the case of food products, paperboard box containers typically include a separate interior package formed of a flexible product wrap such as wax paper, plastic material, or the like, which is sealed and contains the food product. This interior package is inserted into the paperboard box container and maintains the food product in a fresh state until the interior package is opened by the end user.

In contrast, composite paperboard tubular containers typically include a lining layer or coating formed of a plastic or metal, e.g. foil, or the like which substantially reduces permeability of the paperboard material. No separate interior package is required in connection with such composite containers to maintain product freshness. In addition, because the composite paperboard tubular container bodies have a continuously curved wall formed of two or more layers, the body wall has improved strength as compared to the folded box type container.

Composite paperboard tubular container bodies are formed, as will be well known to the skilled artisan, on a mandrel by spiral winding processes, linear draw processes and convolute wrap processes. In such processes, a plurality of single or multi-layer plies are wrapped around the mandrel in a radially layered arrangement and are joined to each other by adhesive applied between the individual plies. Although such composite paperboard containers have found widespread use in commerce, the curved body walls which are generally responsible for various beneficial aspects of the container, including, for example, strength, integrity and the like, have also limited the choice of design and shapes for the container structure and thus have also limited the practical end uses available for the container.

SUMMARY OF THE INVENTION

The present invention provides tubular, non-round composite paperboard container bodies having at least one wall portion defined by radially inverse, i.e., inward curvature, and at least a second wall portion that is outwardly curved.

The inverse curvature body wall portion substantially increases the range of designs and container configurations available to the skilled artisan for achieving numerous functional and design container body attributes, while also retaining the various beneficial attributes of composite container bodies formed by wrapping a plurality of plies around a mandrel.

In one preferred embodiment of the invention, the container body includes at least two body wall portions of inverse curvature, which are positioned in an opposed relationship. The two opposed body wall portions having inverse curvature provide an integral handle allowing easy grasping of the container body by the hand of a consumer, i.e., by the opposed thumb and fingers of a consumer. In one preferred aspect, this container body has a generally oblong cross-section and the opposed wall portions of inverse curvature are positioned on the elongated oblong wall portions at a location closer to one end of the oblong cross-section than to the other oblong end. This configuration provides a particularly desirable, integral handle-type configuration. The container body can be used for packaging of various consumer products and provides a particularly advantageous package for a pourable solid food product such as a crispy, breakfast cereal product. The integral handle allows the package to be easily manipulated by the end user for pouring product out of an open end of the package. At the same time, the curvature of the integral handles and of the other body wall portions of the container body, enhance the radial crush strength of the container body so that grasping of the container body is less likely to fracture or crush the fragile cereal product as it is poured out of the container body.

According to another preferred aspect of the invention, a container comprising the container body according to the invention includes an outwardly-curled beaded top edge portion adapted to receive a membrane closure and a snap-on overcap. Preferably, the container also includes a composite bottom closure. The membrane closure is preferably a peelable closure that can be removed by the end user upon fist use of the contents of the container while the snap-on overcap allows protection of the contents of the container between uses. The membrane closure and/or snap-on overcap can be adapted for closure of all or only a portion of the container top end.

The wall portions of inverse curvature in container bodies of the invention can accomplish other desirable functional aspects in packaging such as providing a divider for separating and stabilizing adjacent rows or stacks of individual product elements, i.e., stacks of crackers, potato chips or the like. The inverse curvature wall portions can also provide unique package configurations allowing packaging differentiation of products in the marketplace.

BRIEF DESCRIPTION OF THE DRAWINGS

In the drawings which form a portion of the original disclosure of the invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will filly convey the scope of the invention to those skilled in the art. Like numbers refer to like elements throughout.

Figure 1:
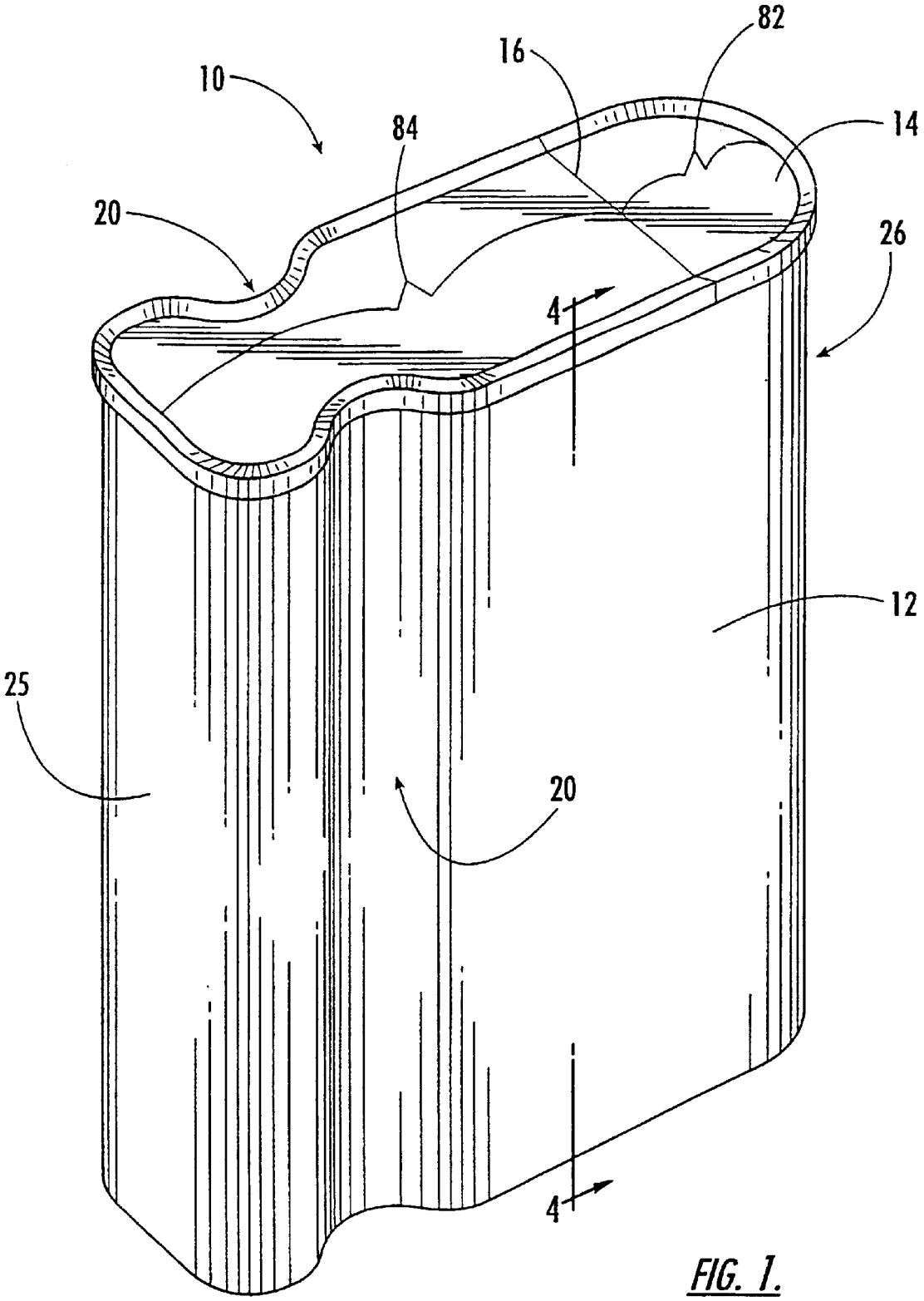
FIG. 1 is a perspective view of one preferred container according to the present invention.
Figure 3:
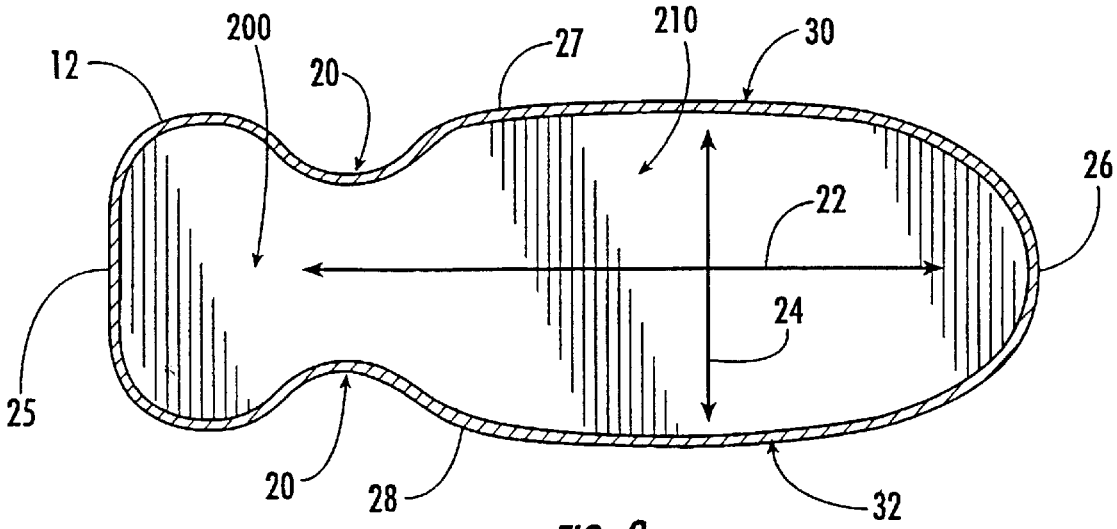
FIG. 3 is a top plan view taken along line 3—3 of FIG. 1 and illustrates the cross-section of the container body.

FIG. 1 illustrates a preferred container 10 of the invention. As illustrated in FIG. 1, the container includes a container body portion 12 and a snap-on overcap 14 which includes an integral hinge 16. As best seen in FIG. 3, the container body includes two opposed body wall portions 20 having inverse or radially inward curvature. As also seen in FIG. 3, the body wall 12 has an overall oblong shape defined by an elongate major axis 22 and a minor axis 24, and corresponding end walls 25, 26, and side walls 27, 28. The inverse curvature body wall portions 20 are formed in the side walls, and are positioned symmetrically on opposing sides of the major axis 22. Advantageously, the inverse curvature body wall portions 20 are positioned closer to one of the end walls, end wall 25, than to the other end wall 26 of the container body. In this configuration, the two inverse curvature body wall portions 20 cooperate to form an integral handle for grasping of the container 10 by a user.

Returning to FIG. 3, it will be seen that each of the side walls 27, 28, includes a nearly flat side body wall portion, 30, 32. Preferably, such body wall portions have a slight outward curvature, which enhances the curl forming operation as discussed hereinafter. It is also preferred that the remaining body portions, including the nearly flat end wall 25, be configured to have at least a slight outward curvature to allow curl formation using a conventional curling apparatus.

Figure 2:
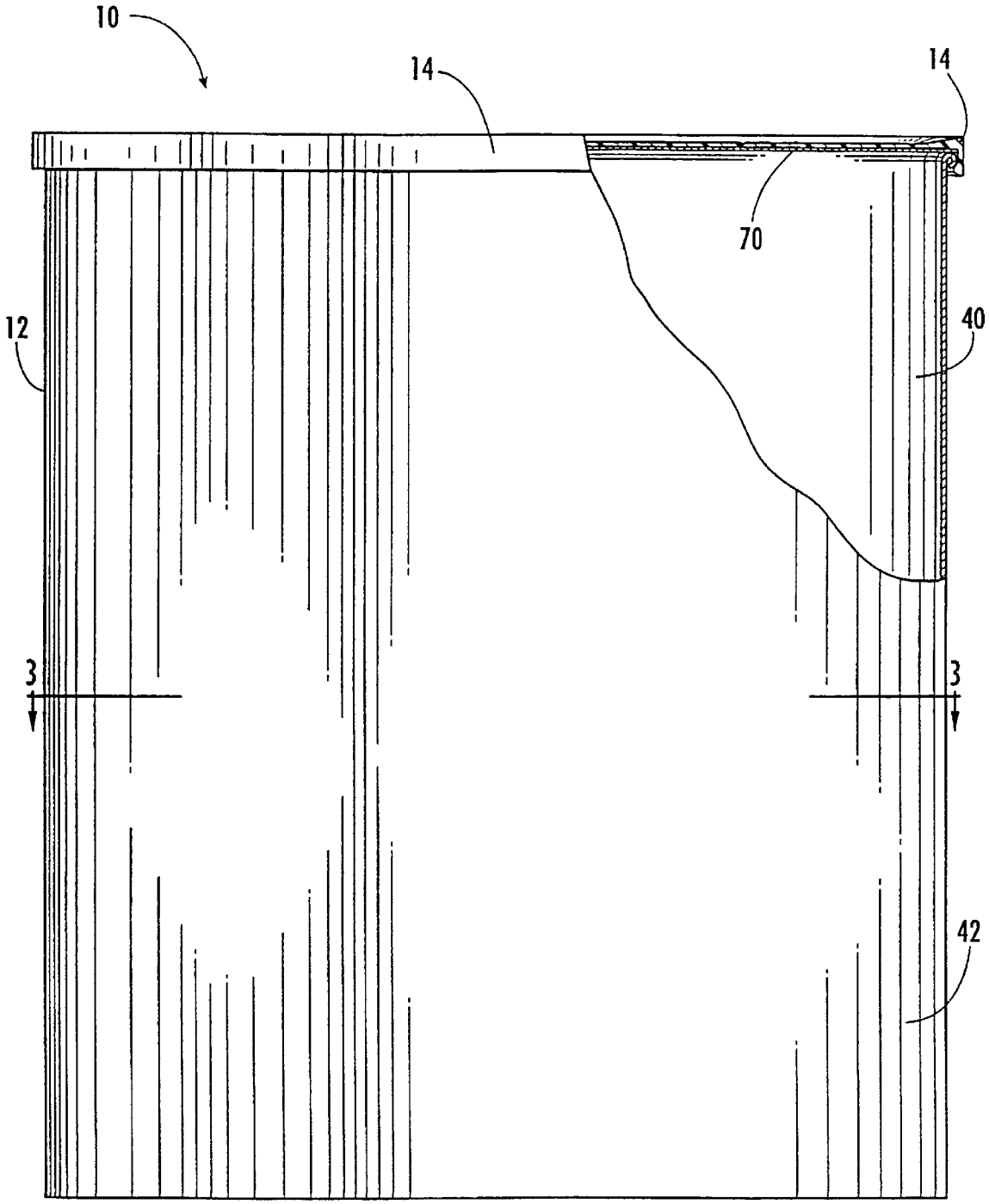
FIG. 2 is a front plan view of the container of FIG. 1 with portions thereof shown in cutaway to illustrate the membrane closure member and the outwardly curled beaded top edge of the container body of FIG. 1.

As best seen in FIG. 2, the container body wall 12 has a substantially uniform diameter and cross-section from top to bottom of the container body, i.e., vertically along the container body. Accordingly, the diameter and cross-section of the container body 12 at a location 40 near the top of the container body is substantially identical to the diameter and cross-section of the container body at a location 42 near the bottom of the container body.

Figure 5:
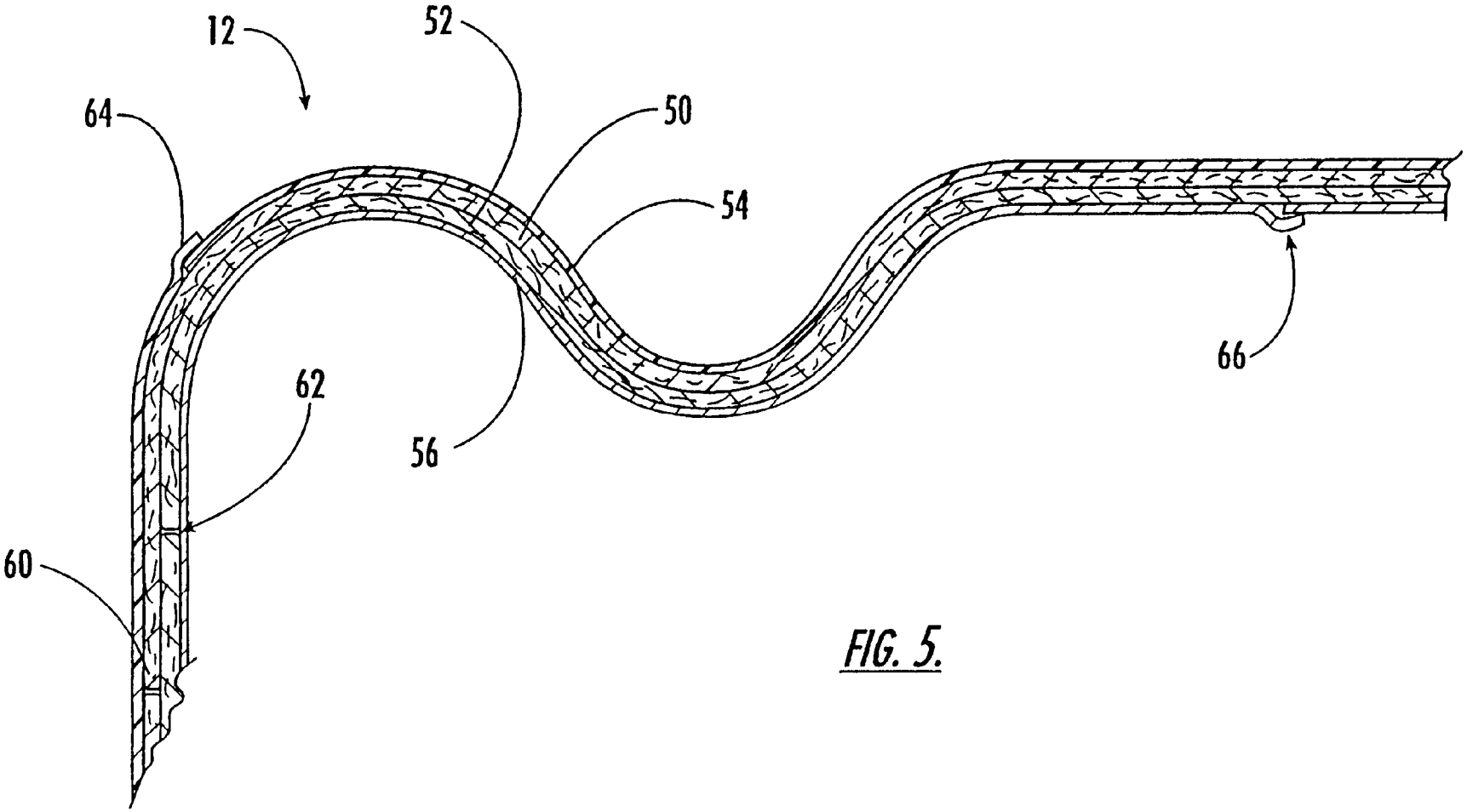
FIG. 5 is a greatly enlarged view of a portion of the body wall cross-section illustrated in FIG. 3.

The composite container body wall 12 can be constructed of a plurality of plies which usually include at least one body ply, a label ply, and a liner ply or coating. More particularly, as best seen in FIG. 5, the construction of the container body wall can include one or more paperboard body wall plies 50 and 52, an exterior label ply 54, and an interior liner ply or coating 56. The liner ply or coating 56 preferably includes a polymer or metallic material of low moisture permeability, i.e., having a moisture permeability substantially less than that of the paperboard ply or plies, such as a flexible plastic film, metal foil, a plastic or metallic coating, or the like. More particularly, the liner ply 56 can be constructed of a polyethylene coated aluminum foil on a paper substrate, a polyethylene coated plastic film or metallicized film on a paper substrate, a plastic or metallicized film on a paper substrate, a hot melt adhesive sealable liner, etc. The body wall ply or plies 50, 52, may comprise one or more plies of recycled or virgin paperboard. Preferably two body plies 50, 52, are used. The label ply 54 can be formed from paper, an aluminum foil laminated paper layer, a polyethylene coated paper layer, a plastic film layer, etc. The composite container body wall 12 can also be constructed from a single wrap, multi-layer ply (not shown) which may be a pre-laminated coated and printed board or body layer with a polyethylene sealing layer thereon. Accordingly, the term, composite paperboard body wall, is used herein to mean a single or multi-ply body wall comprising a paperboard layer and at least one other layer formed of a paperboard or non-paperboard material. Preferably at least one layer is formed of a non-paperboard material.

As also illustrated in FIG. 5, the body wall is of substantially uniform thickness as a result of butt joint seams 60 and 62. Accordingly the body wall is continuous in vertical cross-section, i.e., the body wall forming paperboard plies 50 and 52 are not overlapped substantially. A relatively thin outer label layer 54 is shown to have an overlapped outer portion seam 64. However, the relatively thin nature of the outer label ply is such that the small overlap of seam 64 does not substantially decrease the uniform thickness of the body wall 12. Although body wall 12 is shown to be formed from two paperboard plies 50 and 52, it is within the scope of the invention to form the body wall from a single paperboard ply or from more than two paperboard plies as will be apparent to the skilled artisan. Advantageously, the body wall 12 can have a thickness ranging from about 0.01 inches (0.25 mm) to about 0.05 inches (1.3 mm), for example, about 0.3 inches, (0.75 mm).

This composite container body 12 is preferably formed by a linear draw process, discussed hereinafter, wherein plies are individually wrapped about a mandrel to create a tube having an axially extending seam. Preferably, the seams of the individual plies are staggered. As illustrated in FIG. 5, the liner layer seam 66, the inner body ply seam 60, the outer body ply seam 62, and the label layer seam 64 each extend axially along the container body, parallel to one another. No two seams, however, are in circumferential alignment. Rather, according to a preferred embodiment of the invention, the liner layer seam 66 is positioned adjacent a center portion of one of the side or end walls. The position of the seam in this location is desired so as not to interfere with the curling operation of the beaded edge 72 of the composite container 10. The inner body ply seam 62 may then be positioned in a circumferential location remote from the liner seam 66 and the outer body ply seam 60 may then be positioned in a circumferential location distant from the inner body ply seam 62. Although the seams may be in alignment, it is preferred that they be staggered so as to avoid a particularly weakened area extending axially along the composite container 10. The label ply seam 64 may then be positioned remote from the outer body ply seam 60 and, preferably, adjacent one of the curved corners of the container end walls. The label layer seam 64, so positioned, will not interfere with any text or graphic design on the label layer 64. If the composite container 10 is spirally wound or convolutely wound, it is also preferred that the seams be positioned in a staggered relationship.

Figure 4:
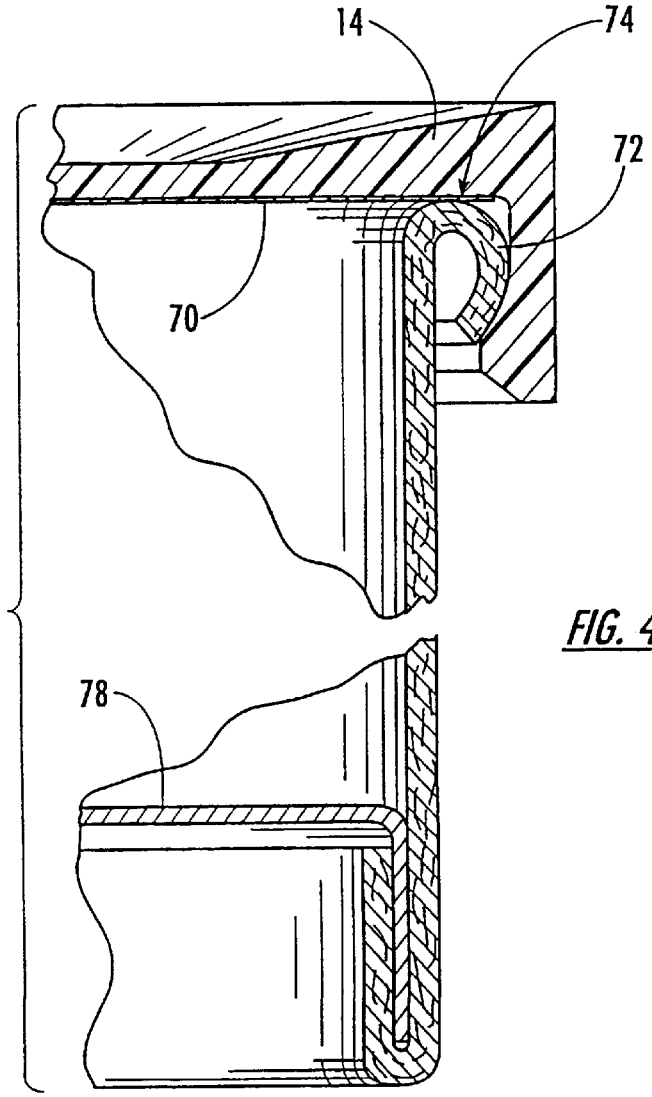
FIG. 4 is a greatly enlarged, exploded, front plan cross-sectional view of a front portion of the top and bottom of the container of FIG. 1 and illustrates the composite bottom closure, the outwardly curled beaded top edge of the container body; the membrane closure member, and the snap-on overcap.

FIGS. 2 and 4 illustrate the membrane closure member 70 and the outwardly curled beaded top edge 72 of the preferred container body construction. The membrane closure member 70 preferably has a shape corresponding to, and slightly larger than the cross-section of the container body (shown in FIG. 3), and is preferably hermetically sealed along the top surface 74 of the curled beaded top edge 72 to the interior liner layer or coating 56 (FIG. 5) by a heat sealing operation or the like as will be readily apparent to those of skill in the art, in order to protect the freshness of the contents of the container. The membrane closure member 70 is preferably a peelable layer that can be removed in whole or in part by peeling after removal of the snap-on overcap 14 (best seen in FIGS. 2 and 4). The membrane closure 70 can be constructed of any of various well known membrane closure materials including a composite material made of a plastic film layer, an aluminum foil layer, an adhesive layer, a paper layer, etc. and can be secured to the beaded top edge 72 by heat sealing, adhesive or other means.

In one preferred embodiment of the invention, best seen in FIG. 1, the snap-on overcap 14 includes an integral hinge 16 positioned near the end wall 26 of the. container body, that is distant from body wall portions 20 having inverse curvature and which cooperate to form an integral handle in the container body. The hinge 16 allows an end portion 82 of the snap-on overcap 14 to be opened for pouring of the contents of the container while the remaining portion 84 of the snap-on overcap 14 remains closed.

Returning to FIG. 4, the container body preferably includes a composite bottom closure member 78. The bottom closure member 78 can be formed of the same composite materials utilized for the container body wall 12 or can be constructed of other materials. The bottom closure 78 can generally be cup shaped and secured to the container body wall 12 by an inwardly curled portion of the bottom of the container body wall 12, and by heat sealing, adhesives, or other desired means.

The beaded top edge 72 of the container body 12 can be formed by conventional beaded or curling equipment well known to those of ordinary skill in the art to produce an outwardly beaded top edge. One particularly desirable curling apparatus is disclosed in U.S. Pat. No. 5,431,619 to Bacon et al. entitled Process and Apparatus for Forming an Outwardly Curled Lip on a Container Body which disclosure is incorporated herein by reference.

The snap-on overcap 14 can be injection molded from low density, linear low density, or high density polyethylene, or it can be thermoformed from a variety of plastic film materials, and can be of conventional construction, generally including a downwardly extending skirt having a configuration for snapping over and being secured around the beaded top edge 72 of the composite container body 12. The resulting composite container 10 is suitable for packaging food or other products as described above and can be hermetically sealed.

Figures 6, 7:
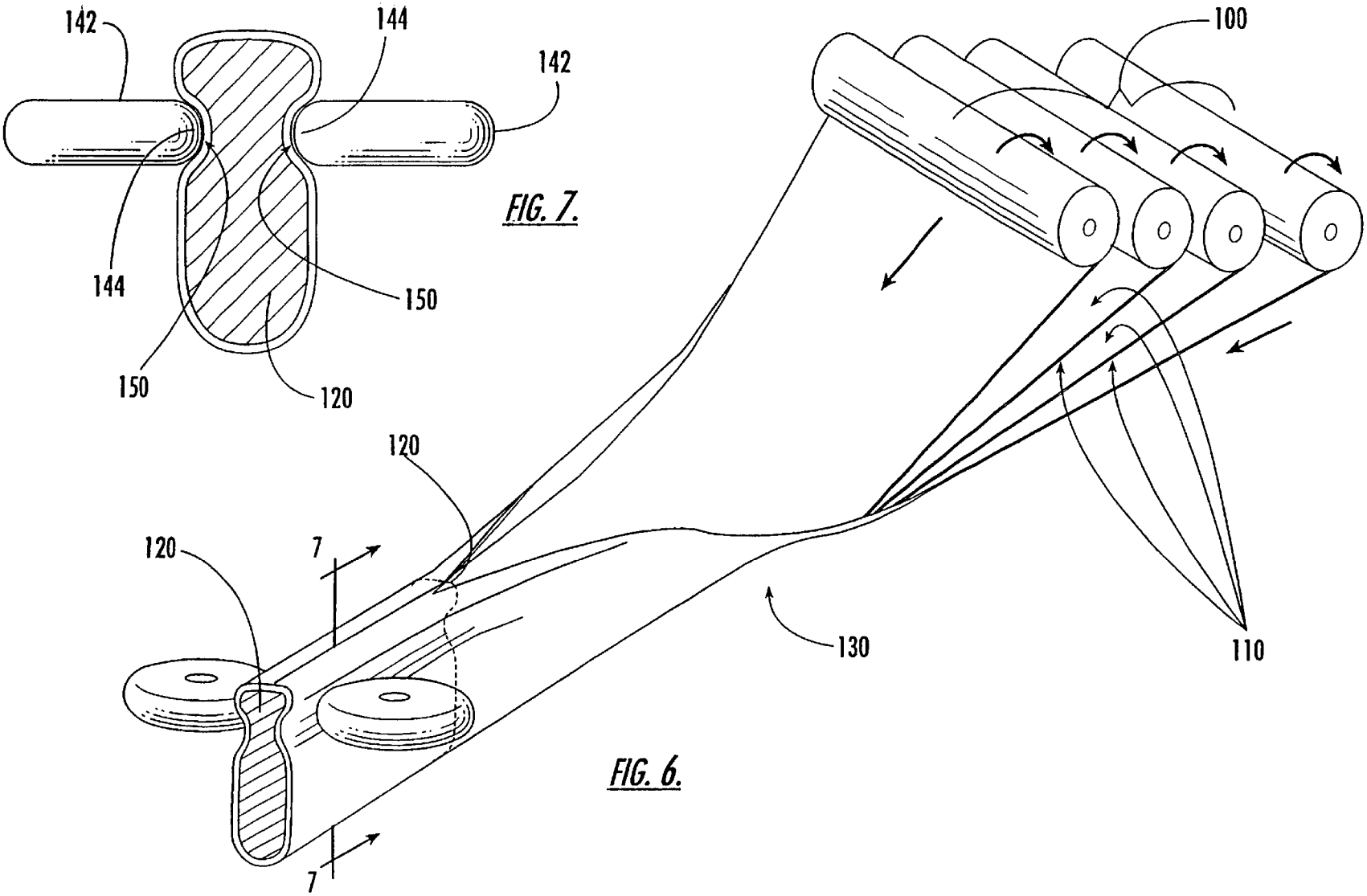
FIG. 6 is a schematic diagram illustrating a preferred linear draw process for forming container bodies of the invention.
FIG. 7 is a schematic illustration taken along lines 7—7 of FIG. 6 and illustrates contoured draw rollers, which cooperate with inwardly curved portions of the mandrel on which the container bodies are formed.

FIGS. 6 and 7 illustrate a linear draw process for forming container bodies of the invention. As seen in FIG. 6, a plurality of continuous plies including two paperboard body wall plies 50 and 52, a label ply 54 and a liner ply 56 are unwound in an unwinding zone 100 and are fed to an adhesive application zone 110 wherein interior surfaces of the plies are coated with adhesive by conventional means (not shown). In order to wrap the multiple plies around a stationary mandrel 120, the plies are passed through a preforming zone 130 wherein curving of the plies is initiated by conventional paper folding guides or the like (not shown).

The multiple plies 50–56 are then fed to a shaped mandrel 120 and are drawn linearly along the mandrel by a plurality of drive rolls. As illustrated in FIG. 7, the drive rolls include two shaped rolls 142 having an outer contoured contact surface 144 of a curvature which matches the curvature of inversely curved portions 150 of the shaped mandrel 120. As will be apparent to those of skill in the art, additional conventional drive rolls (not shown) are also positioned circumferentially around the mandrel 120, to assist in the tubular body wall forming operation and to move the tubular body wall along the mandrel 120. The continuous tubular container body is drawn along the mandrel by the drive rolls and is thereafter passed continuously from the mandrel to a conventional cutting zone (not shown) wherein the continuous container body is cut into a plurality of tubular body wall blanks by a conventional cutting operation.

The containers and container bodies according to the invention can be constructed and varied in numerous different ways as will be apparent to those of skill in the art. For example, a container body can include a plurality of opposed inwardly curved portions to thereby define a plurality of vertically separate container body portions or zones 200 and 210, illustrated in FIG. 3. The zones 200 and 210 can have different cross-sectional lengths as illustrated in FIG. 3, or a plurality of such zones can have substantially uniform cross-sectional lengths (not shown) in order to promote stacking of separate product elements such as cookies, crackers, or the like, in separate stacks in the container. Other variations and modifications of the invention will be apparent to those of skill in the art.

The invention has been described in detail with reference to its preferred embodiments. However, many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the spirit and scope of the appended claims. Although specific terms are employed herein, they are used in a generic and descriptive sense only and not for purposes of limitation.

That which is claimed:

1. A composite container comprising a tubular, non-round composite paperboard container body having at least one wall portion defined by radially inverse curvature, and at least a second wall portion that is outwardly curved, said container body having a substantially uniform diameter and cross-section axially along the container body and having a substantially uniform thickness in vertical cross-section.

2. A composite container according to claim 1 wherein the container body includes at least two body wall portions of inverse curvature which are positioned in an opposed relationship.

3. A composite container according to claim 2 wherein the container body has a generally oblong cross-section defined by opposed side walls and opposed end walls, said opposed wall portions of inverse curvature being positioned symmetrically on the opposed side walls at a location closer to one of said end walls than to the other of said end walls.

4. A composite container according to claim 2 wherein the container body comprises an outwardly-curled beaded top edge portion adapted to receive a membrane closure and a snap-on overcap.

5. A composite container according to claim 3 wherein the container body comprises an outwardly-curled beaded top edge portion adapted to receive a membrane closure and a snap-on overcap.

6. A composite container according to claim 4 wherein the container body comprises a composite bottom closure.

7. A composite container according to claim 5 wherein the container body comprises a composite bottom closure.

8. A composite container according to claim 6 wherein the membrane closure is a peelable hermetically sealed closure.

9. A composite container according to claim 7 wherein the membrane closure is a peelable hermetically sealed closure.

10. A composite container according to claim 4 wherein the snap-on overcap comprises an integral hinge positioned near the end wall of the container body, that is distant from said opposed body wall portions having inverse curvature.

11. A composite container according to claim 4 wherein the container body comprises a plurality of plies including at least one paperboard body ply, and a liner ply or coating comprising a material of low moisture permeability.

12. A composite container according to claim 5 wherein the container body comprises a plurality of plies including at least one paperboard body ply, and a liner ply or coating comprising a material of low moisture permeability.

13. A composite container according to claim 11 wherein the container body comprises an outwardly curled beaded top edge portion said container additionally comprising a membrane closure hermetically sealed to said liner ply or coating.

14. A composite container according to claim 12 wherein the container body comprises an outwardly curled beaded top edge portion, said container additionally comprising a membrane closure hermetically sealed to said liner ply or coating.

15. A composite container according to claim 11 wherein the container body is formed by a linear draw process, such that said container body comprises at least one axially extending seam.

16. A composite container according to claim 11 wherein the container body is formed by a linear draw process, such that each of said plurality of plies comprises an axially extending seam, said seams being circumferentially staggered with respect to each other.

17. A composite container for a pourable food product comprising a tubular, non-round composite paperboard container body having a generally oblong cross-section defined by opposed side walls and opposed end walls, said container body comprising an integrally formed handle defined by opposed wall portions of inverse curvature positioned symmetrically on the opposed side walls at a location closer to one of said end walls than to the other of said end walls, said container body additionally comprising at least one wall portion that is outwardly curved, said container body having a substantially uniform diameter and cross-section axially along the container body and having a substantially uniform thickness in vertical cross-section.

18. A composite container according to claim 17 wherein the container body comprises an outwardly-curled beaded top edge portion adapted to receive a membrane closure and a snap-on overcap.

19. A composite container according to claim 18 wherein the snap-on overcap comprises an integral hinge.

20. A composite container according to claim 17 wherein the container body comprises a plurality of plies including at least one paperboard body ply, and a liner ply or coating comprising a material of low moisture permeability.

21. A composite container according to claim 18 wherein the container body comprises a plurality of plies including at least one paperboard body ply, and a liner ply or coating comprising a material of low moisture permeability.

22. A composite container according to claim 20 wherein the container body comprises an outwardly curled beaded top edge portion, said container additionally comprising an outwardly curled beaded top edge portion, said container additionally comprising a membrane closure hermetically sealed to said liner ply or coating.

23. A composite container according to claim 22 wherein the container body is formed by a linear draw process, such that said container body comprises at least one axially extending seam.

24. A composite container according to claim 22 wherein the container body is formed by a linear draw process, such that each of said plurality of plies comprises an axially extending seam, said seams being circumferentially staggered with respect to each other.

* * * * *